US008604703B2

(12) United States Patent
Lee

(10) Patent No.: US 8,604,703 B2
(45) Date of Patent: Dec. 10, 2013

(54) INDUCTIVE LED LAMP BULB

(75) Inventor: Xian-Liang Lee, Dongguan (CN)

(73) Assignee: Living Style Electric Appliance Co., Ltd, Dong Guan (CN)

( * ) Notice: Subject to any disclaimer, the term of this patent is extended or adjusted under 35 U.S.C. 154(b) by 371 days.

(21) Appl. No.: 12/973,944

(22) Filed: Dec. 21, 2010

(65) Prior Publication Data

US 2012/0153823 A1 Jun. 21, 2012

(51) Int. Cl.
*H05B 37/02* (2006.01)

(52) U.S. Cl.
USPC ..... 315/158; 315/309; 315/185 S; 315/291; 315/312

(58) Field of Classification Search
USPC ..... 315/49–60, 185 S, 247, 224, 291–312, 315/209 R
See application file for complete search history.

(56) References Cited

U.S. PATENT DOCUMENTS

| | | | | |
|---|---|---|---|---|
| 2006/0261739 | A1* | 11/2006 | Lee et al. | 313/634 |
| 2010/0277082 | A1* | 11/2010 | Reed et al. | 315/159 |
| 2011/0234081 | A1* | 9/2011 | Adams | 313/318.01 |
| 2011/0279015 | A1* | 11/2011 | Negley et al. | 313/501 |
| 2012/0014086 | A1* | 1/2012 | Jonsson | 362/84 |
| 2012/0188754 | A1* | 7/2012 | Fitzwater et al. | 362/183 |
| 2012/0319595 | A1* | 12/2012 | Antonopoulos et al. | 315/152 |

* cited by examiner

*Primary Examiner* — Tuyet Thi Vo
(74) *Attorney, Agent, or Firm* — WPAT, PC; Justin King

(57) ABSTRACT

An inductive LED lamp bulb comprising a male connector, casing, LED, lamp panel and PIR sensor, of which the male connector is set at upper part of the casing, both LED and lamp panel are set at lower part of the casing; moreover, the lamp panel covers said LED, while a controller is embedded into said casing, which is also equipped with a timing switch and a contrast switch; said PIR sensor of a removable structure is mounted at the lower part of the casing, and protruded from said lamp panel; said controller is electrically connected with LED, PIR sensor, timing switch and contrast switch; thus, the utility model can be used as a common LED lamp bulb with more control functions and broader range of applications by disassembling easily the PIR sensor.

23 Claims, 2 Drawing Sheets

INDUCTIVE LED LAMP BULB

BACKGROUND OF INVENTION

1. Field of the Invention

The present invention relates generally to a LED lamp bulb, and more particularly to an innovative one which is designed into an inductive LED lamp bulb.

2. Description of Related Art

Lamp bulbs are widely applied to lightings of urban roads, courtyards, corridors, offices and public occasions, etc, for the benefit of the users. The commonly used lamp bulbs include: tungsten lamp bulbs, fluorescent lamp bulbs and LED lamp bulbs, of which LED lamp bulbs are most commonly used due to the advantages such as high efficiency, safety, energy-saving, environmental protection, long service life and quick response.

Existing LED lamp bulbs include common and inductive LED lamp bulbs, of which common ones are turned on or off by a switch, and inductive ones are turned on or off by acoustic or optical elements. As for an inductive LED lamp bulb with PIR (Passive Infrared Radiation) sensor, the IR sensing source of PIR sensor is a thermoelectric substance, which may, in the case of change of the human body's received infrared intensity, lose the charge balance and start to release current, thus obtaining the human sensing signals for controlling on/off state of LED lamps. The PIR sensor of such inductive LED lamp bulb cannot be disassembled, so it cannot be used as a common LED lamp bulb due to limited control functions and applicability.

CONTENT OF INVENTION

The objective of the present invention is to provide an inductive LED lamp bulb, which allows to disassemble the PIR sensor, and to use it as a common LED lamp bulb with more control functions and broader range of applications.

SUMMARY OF THE INVENTION

Present invention adopts the following technology schemes: an inductive LED lamp bulb, which comprises a male connector, casing, LED, lamp panel and PIR sensor, of which the male connector is set at upper part of the casing, both LED and lamp panel are set at lower part of the casing; moreover, the lamp panel covers said LED, whilst a controller is embedded into said casing, which is also equipped with a timing switch and a contrast switch; said PIR sensor of a removable structure is mounted at the lower part of the casing, and protruded from said lamp panel; said controller is electrically connected with LED, PIR sensor, timing switch and contrast switch.

It also comprises an aluminum radiator frame, which is assembled at lower part of the casing; said LED is mounted onto said aluminum radiator frame, and said lamp panel mounted at lower part of said aluminum radiator frame.

A heat-radiating groove is set at periphery of said aluminum radiator frame.

Said aluminum radiator frame is made of aluminum plate.

It also comprises a lamp bulb contrast remote controller, which is connected wirelessly to said controller.

Said LED is a big-power LED.

Said lamp panel is a square shield plate.

Said lamp panel is a cylindrical shield plate.

Said lamp panel is a spherical shield plate.

The efficacies of the inductive LED lamp of present invention include: a controller is embedded into said casing; the casing is also equipped with a timing switch and a contrast switch; said PIR sensor of a removable structure is mounted at the lower part of the casing, and protruded from said lamp panel; said controller is electrically connected with LED, PIR sensor, timing switch and contrast switch; as PIR sensor is of a removable structure, the inductive LED lamp bulb allows to disassemble easily the PIR sensor and use itself as a common LED lamp bulb; Moreover, the timing switch can be used to adjust the working time of LED, i.e. highlighting time of LED, whilst the contrast switch enables the controller to judge if LED functions after obtaining human sensing signals according to the environmental contrast. Hence, this can increase substantially the control functions of said inductive LED lamp bulb and expand its range of applications.

DETAILED DESCRIPTION OF THE INVENTION

Figure 1:
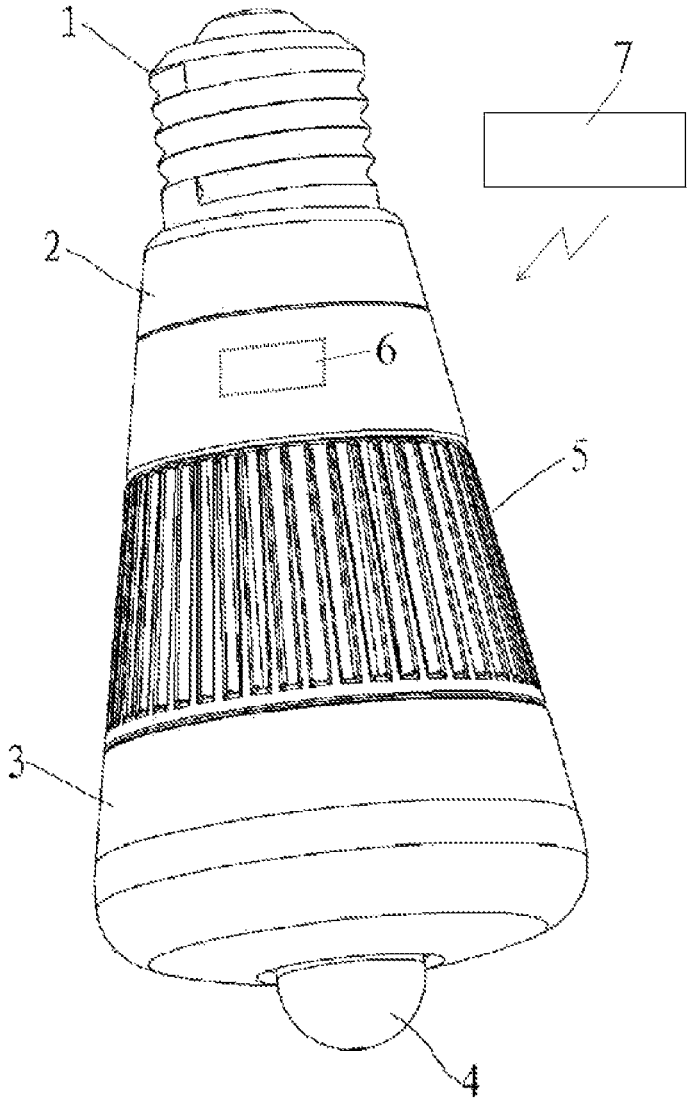
FIG. 1: a structure diagram of preferred embodiment 1 of the present invention.

Referring to FIG. 1 for preferred embodiment 1, an inductive LED lamp bulb comprises: a male connector 1, casing 2, LED, lamp panel 3, PIR sensor 4 and aluminum radiator frame 5; of which the male connector 1 is set at upper part of the casing 2, and the aluminum radiator frame 5 set at lower part of the casing 2; said LED is mounted onto said aluminum radiator frame 5, and said lamp panel 3 mounted at lower part of said aluminum radiator frame 5; the lamp panel 3 covers said LED, whilst a controller is embedded into said casing 2, which is also equipped with a timing switch and a contrast switch; said PIR sensor 4 of a removable structure is mounted at the lower part of the casing 2, and protruded from said lamp panel 3; said controller is electrically connected with LED, PIR sensor 4, timing switch and contrast switch. In this preferred embodiment, said lamp panel 3 is an aesthetically-pleasing cylindrical shield plate. And, said male connector 1 is available with E26, E27 or B22 types with strong applicability.

In this preferred embodiment, said LED is a big-power LED, which is characterized by higher power and brightness.

A heat-radiating groove is set at periphery of said aluminum radiator frame 5. Given higher operating temperature of big-power LED, the service life and radiation quality of the inductive LED lamp bulb will be affected if the heat dissipation of the aluminum radiator frame 5 is poor; in such case, the heat-radiating groove set at periphery of the aluminum radiator frame 5 could improve efficiently the heat dissipation, thereby increasing the service life and radiation quality of the inductive LED lamp bulb.

In this preferred embodiment, said inductive LED lamp bulb of the utility model also comprises a lamp bulb contrast remote controller, which is connected wirelessly to said controller, and used to adjust the contrast of the inductive LED lamp bulb; the lamp bulb contrast remote controller can be designed into a remote controller with or without directional control.

Said inductive LED lamp bulb of the present invention has the following functions: 1) with the setting of the PIR sensor 4, it is possible to sense the temperature of human body with infrared ray and thermopile to obtain the human sensing signals, and automatically control the highlighting or extinguishing state of LED; 2) the inductive timing switch provides a timing mode that permits to adjust the working time of LED, i.e. highlighting time of LED; if the working time of LED is set as 10 s, PIR sensor 4 will sense again the temperature of human body and allow the controller to judge and control if LED is in a highlighting or extinguishing state after LED is highlighted 10 s, 3) the contrast switch provides a LUX contrast adjustment mode, which enables the controller to judge if LED functions after obtaining human sensing signals according to the environmental contrast; if the contrast switch is set as a daytime mode, LED is in an extinguishing state no matter the human sensing signals are acquired in the daytime conditions; if the contrast switch is set as a nighttime mode, the controller could judge and control if LED is in a highlighting or extinguishing state after obtaining the human sensing signals in nighttime conditions; 4) said lamp bulb contrast remote controller could be used to adjust the contrast of inductive LED lamp bulb, thus meeting the demands of different users in various occasions. Thus, said inductive LED lamp bulb of this utility model has a variety of control functions that can be used in a broader range of applications. Additionally, as PIR sensor 4 is of a removable structure, the inductive LED lamp bulb of the utility model can be used as a common LED lamp bulb by disassembling easily the PIR sensor 4.

Figure 2:
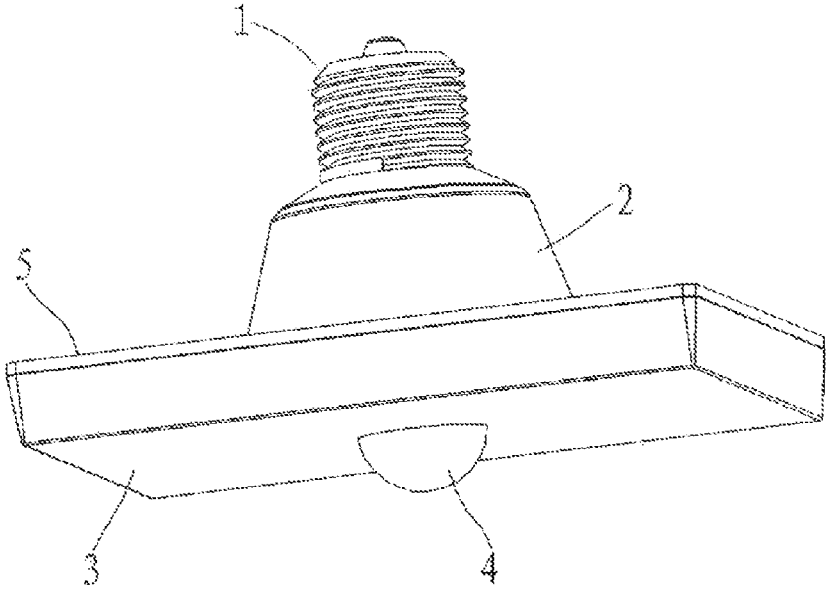
FIG. 2: a structure diagram of preferred embodiment 2 of the present invention.

Referring to FIG. 2 for preferred embodiment 2, its difference with preferred embodiment 1 lies in that, said lamp panel 3 is a square shield plate, so the shape design of the entire inductive LED lamp bulb varies a little. Said lamp panel 3 of the utility model can also be designed into any shape, e.g.: a spherical shield plate. In this preferred embodiment, said aluminum radiator frame 5 is made of aluminum plate with satisfactory heat dissipation effect.

The above is a detailed description of the technical features of the present invention based on typical preferred embodiments. However, it should be appreciated that the present invention is capable of a variety of embodiments and various modifications by those skilled in the art, and all such equivalent variations or changes shall be embraced within the scope of the following claims.

The invention claimed is:

1. An inductive LED lamp bulb, comprising:
- a casing;
- a male connector, rigidly disposed to a first side of the casing;
- an LED;
- a lamp panel, covering the LED;
- a Passive Infrared Radiation sensor, removably disposed on said lamp panel, wherein the Passive Infrared Radiation sensor can be detached and reused on other inductive LED lamp bulbs;
- a controller, disposed within said casing and electrically connected to said LED and Passive Infrared Radiation sensor, further comprising:
  - a timing switch and
  - a contrast switch;
- wherein said LED and lamp panel are disposed to a second side of the casing.

2. The inductive LED lamp bulb of claim 1, further comprising an aluminum radiator frame, disposed on said casing between said LED and said male connector, wherein the LED is mounted onto the aluminum radiator frame.

3. The inductive LED lamp bulb of claim 2, with said aluminum radiator frame further comprising a heat-radiating groove disposed on the periphery of the aluminum radiator frame.

4. The inductive LED lamp bulb of claim 2, wherein said aluminum radiator frame is made of aluminum plate.

5. The inductive LED lamp bulb of claim 1, wherein said controller is wirelessly controlled by a lamp bulb contrast remote controller.

6. The inductive LED lamp bulb of claim 1, wherein said LED is a big-power LED.

7. The inductive LED lamp bulb as claimed in claim 1, wherein said lamp panel is a square shield plate.

8. The inductive LED lamp bulb of claim 1, wherein said lamp panel is a cylindrical shield plate.

9. The inductive LED lamp bulb of claim 1, wherein said lamp panel is a spherical shield plate.

10. An inductive LED lamp bulb, comprising:
- a casing;
- a male connector, disposed to a first side of the casing;
- a LED;
- a lamp panel, covering the LED;
- a Passive Infrared Radiation sensor, removably disposed on said lamp panel;
- a controller, disposed within said casing and electrically connected to said LED and Passive Infrared Radiation sensor, further comprising:
  - a timing switch; and
  - a contrast switch;
- wherein said LED and lamp panel are disposed to a second side of the casing.

11. The inductive LED lamp bulb of claim 10, further comprising an aluminum radiator frame, disposed on said casing between said LED and said male connector, wherein the LED is mounted onto the aluminum radiator frame.

12. The inductive LED lamp bulb of claim 11, with said aluminum radiator frame further comprising a heat-radiating groove disposed on the periphery of the aluminum radiator frame.

13. The inductive LED lamp bulb of claim 11, wherein said aluminum radiator frame is made of aluminum plate.

14. The inductive LED lamp bulb of claim 10, wherein said controller is wirelessly controlled by a lamp bulb contrast remote controller.

15. The inductive LED lamp bulb of claim 10, wherein said LED is a big-power LED.

16. The inductive LED lamp bulb of claim 10, wherein said lamp panel is a square shield plate.

17. The inductive LED lamp bulb of claim 10, wherein said lamp panel is a cylindrical shield plate.

18. The inductive LED lamp bulb of claim 10, wherein said lamp panel is a spherical shield plate.

19. An inductive LED lamp bulb, comprising:
- a casing;
- a male connector, disposed to a first side of the casing;
- a LED;
- a lamp panel, covering the LED;
- a controller, disposed within said casing and electrically connected to said LED, further comprising a timing switch and a contrast switch; and
- a Passive Infrared Radiation sensor, comprising a removable structure, electrically connecting to said controller when the Passive Infrared Radiation sensor is disposed on said lamp panel by said removable structure;
- wherein said LED and lamp panel are disposed to a second side of the casing.

20. The inductive LED lamp bulb of claim 19, further comprising an aluminum radiator frame, disposed on said casing between said LED and said male connector, wherein the LED is mounted onto the aluminum radiator frame.

21. The inductive LED lamp bulb of claim 20, with said aluminum radiator frame further comprising a heat-radiating groove disposed on the periphery of the aluminum radiator frame.

22. The inductive LED lamp bulb of claim 20, wherein said aluminum radiator frame is made of aluminum plate.

23. The inductive LED lamp bulb of claim 19, wherein said controller is wirelessly controlled by a lamp bulb contrast remote controller.

* * * * *